US010330303B2

(12) United States Patent
Kwak et al.

(10) Patent No.: US 10,330,303 B2
(45) Date of Patent: Jun. 25, 2019

(54) LIGHT EMITTING DEVICE MODULE WITH HEAT-SINK AND AIR GUIDE

(71) Applicant: LG Electronics Inc., Seoul (KR)

(72) Inventors: Jinsung Kwak, Seoul (KR); Junhyung Kim, Seoul (KR); Hongseok Kim, Seoul (KR); Yongjin Kim, Seoul (KR); Seoyoung Jeong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 196 days.

(21) Appl. No.: 14/512,075

(22) Filed: Oct. 10, 2014

(65) Prior Publication Data

US 2015/0138770 A1 May 21, 2015

(30) Foreign Application Priority Data

Nov. 20, 2013 (KR) ..... 10-2013-0141053
Nov. 25, 2013 (KR) ..... 10-2013-0144031

(51) Int. Cl.

| | |
|---|---|
| ***F21V 29/00*** | (2015.01) |
| ***F21V 29/74*** | (2015.01) |
| ***F21V 5/04*** | (2006.01) |
| ***F21V 21/00*** | (2006.01) |
| ***F21K 9/00*** | (2016.01) |
| ***F21V 29/83*** | (2015.01) |
| ***F21K 9/20*** | (2016.01) |
| *F21W 131/10* | (2006.01) |
| *F21W 131/30* | (2006.01) |
| *F21W 131/40* | (2006.01) |
| *F21Y 105/00* | (2016.01) |
| *F21Y 113/00* | (2016.01) |

(Continued)

(52) U.S. Cl.

CPC ..... *F21V 29/74* (2015.01); *F21K 9/00* (2013.01); *F21K 9/20* (2016.08); *F21V 5/04* (2013.01); *F21V 21/00* (2013.01); *F21V 29/83* (2015.01); *F21W 2131/10* (2013.01); *F21W 2131/30* (2013.01); *F21W 2131/40* (2013.01); *F21Y 2101/00* (2013.01); *F21Y 2105/00* (2013.01); *F21Y 2105/10* (2016.08); *F21Y 2113/00* (2013.01); *F21Y 2115/10* (2016.08)

(58) Field of Classification Search

CPC ..... F21V 29/20; F21V 29/74; F21V 29/83
USPC ..... 362/294
See application file for complete search history.

(56) References Cited

U.S. PATENT DOCUMENTS 6,154,362 A * 11/2000 Takahashi ..... G09F 9/33 257/E25.028
7,950,828 B2 5/2011 Zhang et al.
(Continued)

FOREIGN PATENT DOCUMENTS

JP 2010-526416 A 7/2010
KR 20-2009-0009585 A 9/2009
(Continued)

*Primary Examiner* — Gerald J Sufleta, II
(74) *Attorney, Agent, or Firm* — Birch, Stewart, Kolasch & Birch, LLP

(57) ABSTRACT

A module array includes a light emitting device module. The light emitting device module includes a light source unit, a body provided at one surface thereof with a seat on which the light source unit is seated, a plurality of radiation fins disposed on the other surface of the body opposite to one surface of the body, and an air hole perforated in the body from the seat to the radiation fins for the flow of air.

17 Claims, 11 Drawing Sheets

(51) Int. Cl.

| | |
|---|---|
| *F21Y 101/00* | (2016.01) |
| *F21Y 105/10* | (2016.01) |
| *F21Y 115/10* | (2016.01) |

(56) References Cited

U.S. PATENT DOCUMENTS

| | | | | |
|---|---|---|---|---|
| 7,967,473 | B2 | 6/2011 | Huang et al. | |
| 8,007,127 | B2 | 8/2011 | Kim et al. | |
| 8,172,425 | B2 | 5/2012 | Wen et al. | |
| 8,256,919 | B2 | 9/2012 | Holder et al. | |
| 8,348,461 | B2 | 1/2013 | Wilcox et al. | |
| 8,419,217 | B2 | 4/2013 | Lu et al. | |
| 2011/0317420 | A1 | 12/2011 | Jeon et al. | |
| 2011/0317425 | A1 | 12/2011 | Jeon et al. | |
| 2012/0033419 | A1* | 2/2012 | Kim | F21S 8/026 362/235 |
| 2013/0044478 | A1* | 2/2013 | Steedly | F21V 3/049 362/235 |
| 2013/0088871 | A1* | 4/2013 | Yun | F21S 4/28 362/249.01 |
| 2013/0135865 | A1* | 5/2013 | Lin | H01L 23/36 362/249.02 |

FOREIGN PATENT DOCUMENTS

| | | | |
|---|---|---|---|
| KR | 10-2010-0034262 | A | 4/2010 |
| KR | 10-2011-0060476 | A | 6/2011 |
| KR | 10-1191306 | B1 | 10/2012 |
| KR | 10-1274576 | B1 | 6/2013 |
| KR | 10-1310365 | B1 | 9/2013 |
| KR | 10-1412958 | B1 | 6/2014 |
| WO | WO 2008/137732 | A1 | 11/2008 |
| WO | WO 2012/101097 | A1 | 8/2012 |

* cited by examiner

LIGHT EMITTING DEVICE MODULE WITH HEAT-SINK AND AIR GUIDE

CROSS-REFERENCE TO RELATED APPLICATIONS

This application claims the priority benefit of Korean Patent Application No. 10-2013-0141053, filed on Nov. 20, 2013 and Korean Application No. 10-2013-0144031 filed on Nov. 25, 2013 in the Korean Intellectual Property Office, the disclosures of which are incorporated herein by reference.

BACKGROUND OF THE INVENTION

1. Field of the Invention

Embodiments relate to a module array and a lighting apparatus having the same.

2. Description of the Related Art

In general, bulbs or fluorescent lamps are frequently used for indoor or outdoor lighting. These bulbs or fluorescent lamps problematically require frequent replacement due to a relatively short lifespan thereof. In addition, conventional fluorescent lamps deteriorate over time, thus suffering from a gradual reduction in the intensity of illumination.

To solve the above problems, various shapes of lighting modules using Light Emitting Diodes (LEDs) have been developed because light emitting diodes exhibit excellent control efficiency, rapid responsiveness, high photoelectric conversion efficiency, long lifespan, low power consumption and high brightness and may be used to provide mood lighting.

Light emitting diodes are semiconductor devices that convert electric energy into light. Such light emitting diodes have several advantages, such as low power consumption, semipermanent lifespan, rapid responsiveness, safety and eco-friendly properties, as compared to conventional light sources, such as fluorescent lamps, incandescent bulbs, etc. For this reason, replacement of conventional light sources with light emitting diodes is being performed, and light emitting diodes are increasingly being used as light sources of indoor and outdoor lighting devices, such as various liquid crystal display devices, electronic display boards, street lights, etc.

Such light emitting devices are fabricated in the form of a light emitting device module for convenience of assembly and protection against external shock and moisture.

The light emitting device module, however, problematically generates extreme heat due to high integration density of light emitting devices.

SUMMARY OF THE INVENTION

Embodiments herein provide a module array and a lighting apparatus having the same, which may effectively radiate heat generated from light emitting devices.

In one embodiment, a module array includes at least one light emitting device module, wherein the light emitting device module includes a light source unit, a body provided at one surface thereof with a seat on which the light source unit is seated, a plurality of radiation fins disposed on the other surface of the body opposite to one surface of the body, and an air hole perforated in the body from the seat to the radiation fins for the flow of air.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Figure 1:
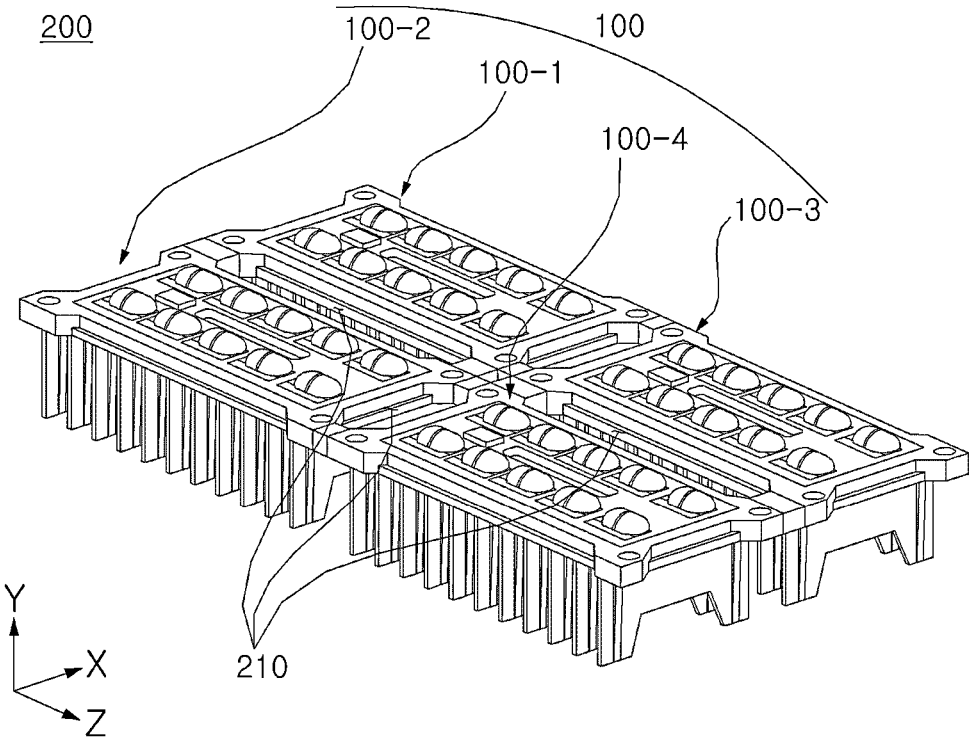
FIG. 1 is a perspective view of a module array according to one embodiment of the present invention.

Advantages and features of the present invention and a method of achieving the same will be more clearly understood from embodiments described below with reference to the accompanying drawings. However, the present invention is not limited to the following embodiments but may be implemented in various different forms. The embodiments are intended merely to provide a complete disclosure of the present invention to a person having ordinary skill in the art to which the present invention pertains. The scope of the invention is intended to be defined only by the claims. Wherever possible, the same reference numbers will be used throughout the specification to refer to the same or like parts.

In addition, angles and directions referred to during the description of a structure of an embodiment are described based on illustration in the drawings. In the description of the structure of the embodiment, if reference points with respect to the angles and positional relations are not clearly stated, the related drawing will be referred to.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and should not be interpreted in an idealized or overly formal sense unless expressly so defined herein.

Hereinafter, the embodiments will be described in detail with reference to the drawings.

Figure 2:
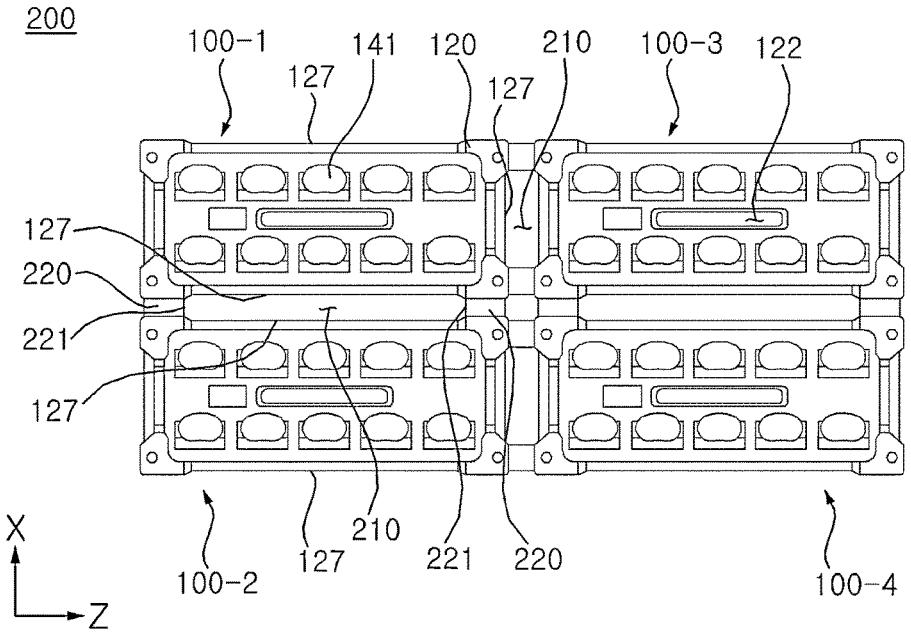
FIG. 2 is a lower side view of the module array shown in FIG. 1.
Figure 3:
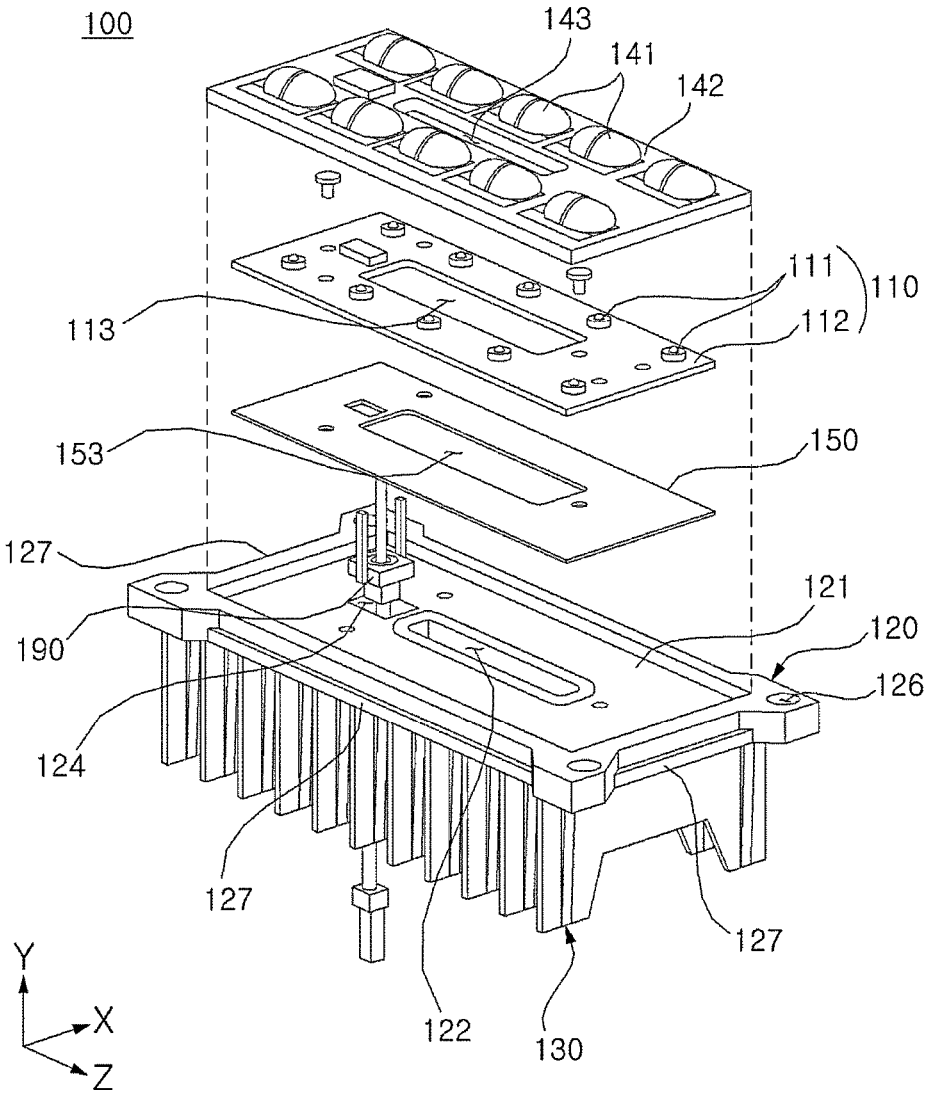
FIG. 3 is an exploded perspective view of a light emitting device module according to a first embodiment.
Figure 4:
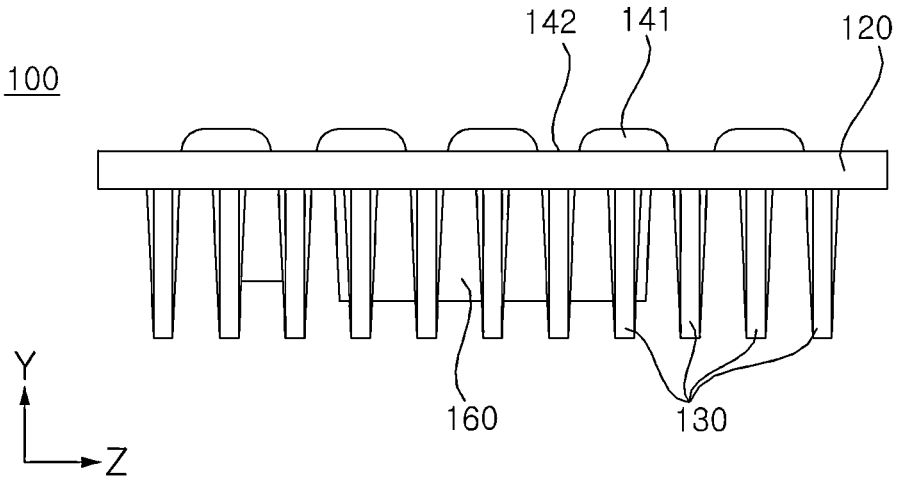
FIG. 4 is a front view of the light emitting device module according to the first embodiment.
Figure 5A:
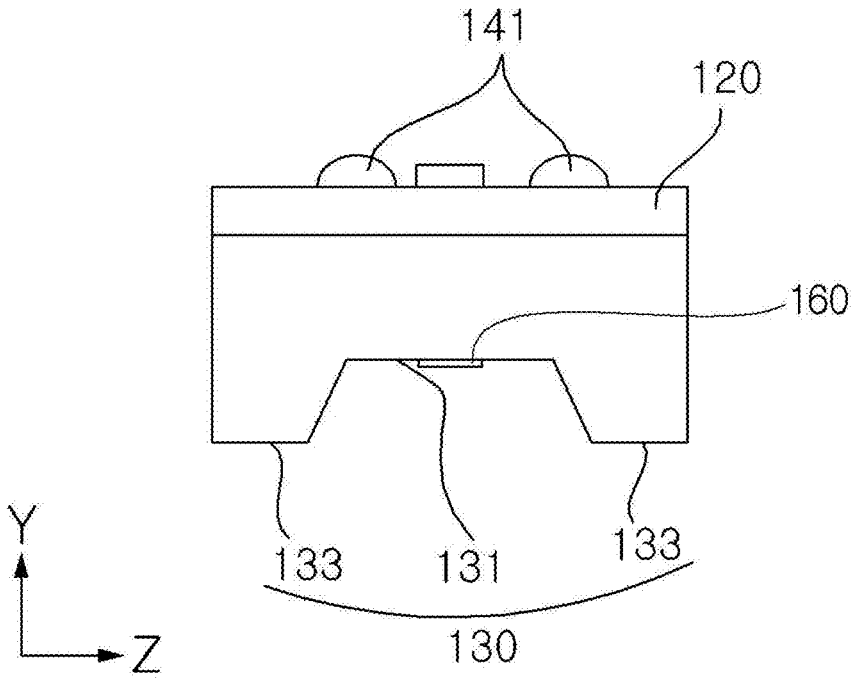
FIG. 5*a* is a side view and FIG. 5*b* is an upper side view of the light emitting device module according to the first embodiment.
Figure 5B:
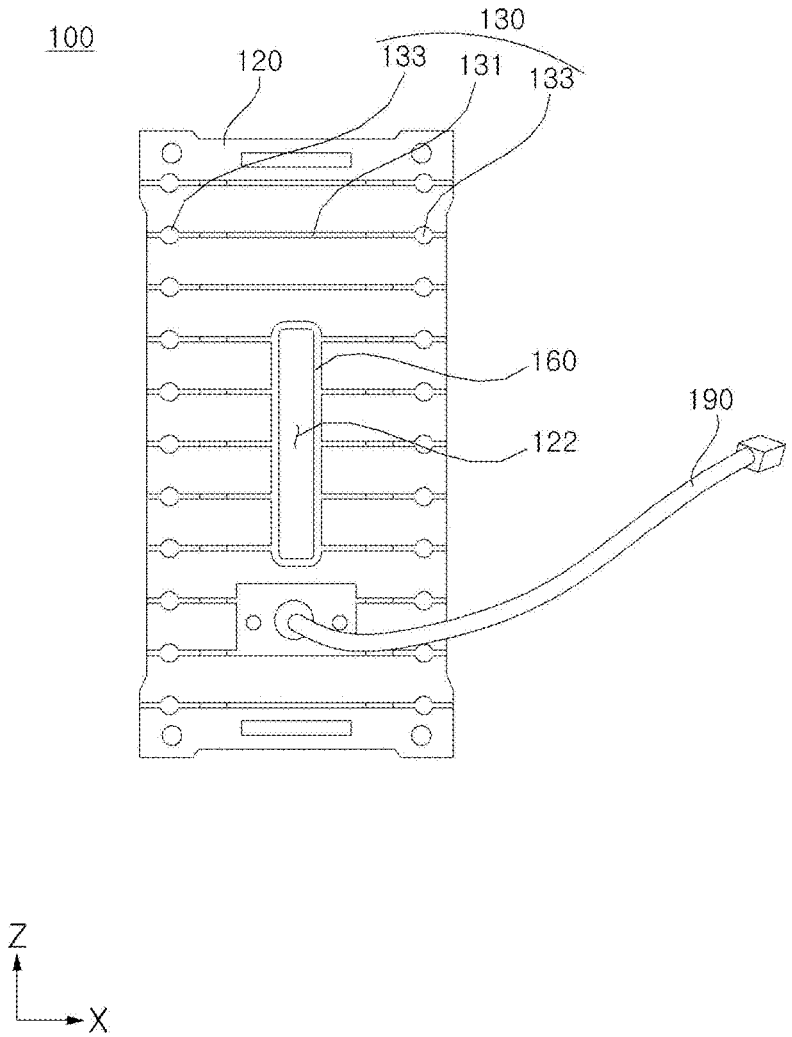

FIG. 1 is a perspective view of a module array according to one embodiment of the present invention, FIG. 2 is a lower side view of the module array shown in FIG. 1, FIG. 3 is an exploded perspective view of a light emitting device module according to a first embodiment, FIG. 4 is a front view of the light emitting device module according to the first embodiment, and FIG. 5*a* is a side view and FIG. 5*b* is an upper side view of the light emitting device module according to the first embodiment.

The module array according to one embodiment, designated by reference numeral 200, includes a single light emitting device module 100, or includes at least two light emitting device modules 100 arranged in combination with each other. For example, the module array 200 may include four light emitting device modules 100-1, 100-2, 100-3 and 100-4, arranged as shown in FIGS. 1 and 2. The light emitting device module 100 constituting the module array 200 will first be described below.

Referring to FIGS. 3 to 5*b*, the light emitting device module 100, which constitutes the module array 200, may include a light source unit 110, a body 120 provided at one surface thereof with a seat 121 on which the light source unit 110 is seated, and a plurality of radiation fins 130 arranged at the other surface of the body 120 opposite to the one surface of the body 120 provided with the seat 121.

In addition, the light emitting device module 100 may include an air hole 122 perforated in the body 120 from the seat 121 to the radiation fins 130 for the flow of air.

The light source unit 110 may include various types of devices for the generation of light.

The light source unit 110 includes a board 112 and light emitting devices 111 disposed on the board 112, the light emitting devices 111 being electrically connected to the board 112.

The board 112 is disposed on one surface of the body 120. The board 112 takes the form of a rectangular board corresponding to one surface of the body 120, without being limited thereto. For example, the board 112 may have one of various shapes, such as a polygonal shape, an oval shape, etc. The board 112 may include a circuit pattern printed on an insulator. For example, the board 112 may be a general Printed Circuit Board (PCB), a metal core PCB, a flexible PCB, a ceramic PCB or the like.

The light source unit 110 may be Chip On Board (COB) to which LED chips can be directly bonded, rather than being packaged on a printed circuit board. The COB is formed of ceramic, thus achieving heat resistance and electrical insulation.

An upper surface of the board 112 may be coated with a material capable of efficiently reflecting light. For example, the upper surface of the board 112 may be coated with a white or silvery material.

A single light emitting device or a plurality of light emitting devices 111 may be arranged. In addition, in the case of arrangement of the plurality of light emitting devices 111, the respective light emitting devices 111 may emit different colors of light, or may exhibit different color temperatures.

The light source unit 110 may be disposed on the seat 121 formed at one surface of the body 120 and be supported by the body 120. The seat 121 may be indented in one surface of the body 120, and the board 112 may have a shape corresponding to the shape of the seat 121 so as to be inserted into the seat 121.

The board 112 may have a board hole 113 communicating with the air hole 122. The board hole 113 is positioned to overlap the air hole 122 in the vertical direction (in the Y-axis) and is in communication with the air hole 122 to provide an air flow space.

Here, the term "vertical" is not limited to completely vertical (90 degrees to a horizontal X-axis), but instead may include a range of angular deviation (for example 45 degrees) from completely vertical without departing from the scope of the invention.

The light emitting devices 111 on the board 112 may be arranged to surround the board hole 113. More specifically, the board hole 113 may be perforated in the board 112 in the Y-axis, and the light emitting devices 111 may be arranged around the board hole 113 in the X-Z plane.

A heat radiation pad 150 may be additionally provided between the board 112 and the seat 121 for enhancement of heat transfer. The heat radiation pad 150 may have a shape corresponding to the seat 121 and may be formed of a material having excellent heat transfer and adhesion properties. For example, the heat radiation pad 150 may be formed of silicon. The heat radiation pad 150 may be a film and have a pad hole 153 communicating with the air hole 122.

The light emitting device module 100 may further include a plurality of lenses 141 which shield the light emitting devices 111 and refract light emitted from the light emitting devices 111. The lenses 141 function to diffuse light emitted from the light emitting devices 111. A diffusion angle of light emitted from the light emitting devices 111 may be determined based on the shape of the lenses 141. For example, the lenses 141 may allow the light emitting devices 111 to be molded in a convex form.

The lenses 141 may be formed of a light transmitting material. For example, the lenses 141 may be formed of transparent silicon, epoxy and one or more various other resins.

In addition, each lens 141 may be positioned to enclose the light emitting device 111 to isolate the light emitting device 111 from the outside, in order to protect the light emitting device 111 from external moisture and shock.

For convenience of assembly, the lenses 141 may be disposed on a lens cover 142 having a shape corresponding to the shape of the board 112. The lens cover 142 may be formed to correspond to the board 112, and the lenses 141 on the lens cover 142 may be positioned to overlap the respective light emitting devices 111. The lens cover 142 may have a cover hole 143 communicating with the air hole 122.

The lenses 141 may be integrated with the lens cover 142 to enable easy assembly of the lenses 141 that shield the respective light emitting devices 111. In this case, the cover hole 143 assists positional alignment of the lens cover 142 and provides a flow space of air for passage through the air hole 122. More specifically, the cover hole 143 may be perforated in the center of the lens cover 142 in the vertical direction (in the Y-axis). The cover hole 143 may be positioned to correspond to the air hole 122. The cover hole 143 serves as a space for radiation of heat from the lens cover 142.

The body 120 provides a seating space for the light source unit 110 and transfers heat generated in the light source unit 110 to the radiation fins 130.

To enhance heat transfer efficiency, the body 120 may be formed of a metal material or a resin material having excellent heat radiation efficiency, without being limited thereto.

For example, a constituent material of the body 120 may include at least one of aluminum (Al), nickel (Ni), copper (Cu), silver (Ag) and tin (Sn). In addition, the body 120 may be formed of at least one of a resin material such as polyphthalamide (PPA), silicon (Si), aluminum (Al), aluminum nitride (AlN), photosensitive glass (PSG), polyamide9T (PA9T), new geo tactics polystyrene (SPS), a metal material, sapphire (Al2O3), beryllium oxide (BeO) and ceramic. The body 120 may be formed by injection molding, etching, etc., without being limited thereto.

The body 120 may be provided at one surface thereof with the seat 121 on which the light source unit 110 is seated and at the other surface thereof with the radiation fins 130. The body 120 may take the form of a rectangular plate having a plane (the X-Z plane).

The seat 121 may be indented in one surface (for example, an upper surface) of the body 120 and have a shape corresponding to the shape of the board 112.

Screw holes 126 may be formed in corners of the body 120 such that screws are fastened through the screw holes 126 for coupling the body 120 to a lighting apparatus, for example.

Referring to FIG. 4, the radiation fins 130 may have a shape to maximize an air contact area thereof. Specifically, the radiation fins 130 may take the form of a plurality of plates extending downward (i.e. in the Y-axis direction) from the other surface (for example, a lower surface) of the body 120. More specifically, the radiation fins 130 may be arranged at a constant pitch, and the width of the respective radiation fins 130 may be equal to the width of the body 120 for effective transfer of heat from the body 120 to the radiation fins 130.

The radiation fins 130 may be integrally molded with the body 120, or may be fabricated as separate elements. The radiation fins 130 may be formed of a material having high heat transfer efficiency, for example, at least one of aluminum (Al), nickel (Ni), copper (Cu), silver (Ag) and tin (Sn).

Referring to FIGS. 4, 5*a* and 5*b*, the radiation fins 130 may be elongated in the transverse direction of the body 120 (in the X-axis) and may be arranged at a constant pitch in the longitudinal direction of the body 120 (in the Z-axis).

A center portion 131 of each radiation fin 130 may be indented toward the body 120 from both end portions 133 of the radiation fan 130. Since both end portions 133 of the radiation fin 130 vertically overlap the light emitting devices 111, the end portions 133 of the radiation fin 130 may have a greater height than that of the center portion 131 of the radiation fin 130 to achieve an increased air contact area. Moreover, the indented center portion 131 of the radiation fin 130 may provide reduced manufacturing costs.

Referring again to FIGS. 1 and 3, the air hole 122 is perforated in the body 120 from the seat 121 to the radiation fins 130 (in the Y-axis) to provide an air flow space. The air hole 122 may be perforated in the central region of the body 120 so as to extend by a long length in the longitudinal direction of the body 120.

The air hole 122 may vertically overlap the board hole 113 perforated in the board 112, the cover hole 143 perforated in the lens cover 142 and the pad hole 153 perforated in the heat radiation pad 150 and communicate with the same.

As air flows through the air hole 122 by a temperature difference between the exterior and the interior of the air hole 122, cooling of the radiation fins 130 and the body 120 may be accelerated.

Specifically, the air hole 122 may vertically overlap the center portion 131 of the respective radiation fins 130 and the light emitting devices 111 may vertically overlap both end portions 133 of the respective radiation fins 130.

More specifically, as exemplarily shown in FIG. 3, the air hole 122 may be formed in a central region of the body 120 and be elongated in a first direction (the Z-axis) and the light emitting devices 111 may be spaced apart from one another in the longitudinal direction of the air hole 122.

In this case, a majority of the light emitting devices 111 may be arranged proximate to the longitudinal side of the air hole 122. That is, the light emitting devices 111 may be arranged in two rows in the first direction, the air hole 122 may be elongated in the first direction between the two rows of the light emitting devices 111, and a majority of the light emitting devices 111 may be arranged proximate to the longitudinal edge of the air hole 122. This configuration enables effective heat transfer. Of course, the board hole 113 may have a shape corresponding to the shape of the air hole 122.

In addition, when viewed from the upper side, the area of the air hole 122 may be in a range of 10% to 20% of the area of the body 120.

The light emitting device module 100 may further include an air guide 160 protruding in the Y-axis from the other surface of the body 120 along the rim of the air hole 122. The air guide 160 is in communication with the air hole 122 to form a channel to guide air.

The air guide 160 may be cylindrical member having an inner space and the rim of the air guide 160 may overlap the rim of the air hole 122. That is, the air guide 160 may take the form of a chimney surrounding the air hole 122. The air guide 160 may have a shape corresponding to the shape of the air hole 122 elongated in the Z direction as shown in FIG. 3.

The air guide 160 may be formed of a material having high heat transfer efficiency. For example, the air guide 160 may include at least one of aluminum (Al), nickel (Ni), copper (Cu), silver (Ag) and tin (Sn). In addition, the air guide 160 may be formed of at least one of a resin material such as polyphthalamide (PPA), silicon (Si), aluminum (Al), aluminum nitride (AlN), photosensitive glass (PSG), polyamide9T (PA9T), new geo tactics polystyrene (SPS), a metal material, sapphire (Al2O3), beryllium oxide (BeO) and ceramic.

The air guide 160 and the radiation fins 130 extend outwardly from the other surface of the body 120 in the same direction such that the air guide 160 extends along the radiation fins 130. The air guide 160 may be connected to at least some of the radiation fins 130 and receive heat transferred from the light emitting devices 111 to the radiation fins 130.

Accordingly, owing to a temperature difference between the exterior and the interior of the air hole 122 and the air guide 160, air is guided through the air hole 122 and the air guide 160.

When the light emitting device module 100 is arranged in use, for example as a portion of a streetlight, the light source units 110 direct light downwardly to illuminate the street below. Because the light source units produce heat, although some of the heat is dissipated by the radiation fins 130 oriented above the light source units 110, a considerable amount of heat is developed directly below the light emitting device module 100. To facilitate a reduction in this heat below the light emitting device module 100, the air guide 160 acts as a passive airflow promotion channel together with the generated heat to induce an airflow through the air guide 160 from the bottom side of the light emitting device module 100 to the top side of the light emitting device module 100.

The body 120 may have a connector hole 124 for passage of a connector 190 used to supply power to the light emitting devices 111.

Referring again to FIGS. 1 and 2, the module array 200 according to the embodiment, as described above, may be constructed by coupling a plurality of light emitting device modules 100 to one another.

Specifically, the module array 200 may be constructed as the plurality of light emitting device modules 100 is arranged in a direction parallel to one surface of the body 120 of each light emitting device module 100 (in the X-Z plane, hereinafter referred to as the horizontal direction).

More specifically, the module array 200 may be constructed as the plural light emitting device modules 100 are arranged at a constant pitch. In addition, as exemplarily shown in FIG. 2, the module array 200 may be constructed as the plural light emitting device modules 100 are arranged in the transverse direction and/or the longitudinal direction thereof.

The module array 200 defines air flow holes 210 between the light emitting device modules 100. The air flow holes 210 extend from one surface to the other surface of the module array 200 (in the Y-axis, hereinafter referred to as the vertical direction) to provide an air flow space.

The air flow holes 210 are located between the light emitting device modules 100 and serve to facilitate the circulation of air by a temperature difference between the interior and the exterior of the air flow holes 210.

The interior of the air flow hole 210 is heated by heat transferred from the light emitting devices 111 through the body 120. As the heated air is moved upward by buoyancy, a flow of air from the bottom to the top of the air flow hole 210 is created (so-called chimney effect).

Accordingly, the air flow holes 210 defined between the light emitting device modules 100 may function to effectively dissipate heat generated by the light emitting device modules 100.

For example, each air flow hole 210 may be defined between the bodies 120 of the two neighboring light emitting device modules 100.

Specifically, the air flow hole 210 may be located between the body 120 of a first light emitting device module 100-1 and the body 120 of a second light emitting device module 100-2 that is proximate to the first light emitting device module 100-1.

More specifically, side surfaces 127 of the bodies 120 of the two neighboring light emitting device modules may define a portion of the inner circumferential surface of the air flow hole 210. Here, the side surface 127 of the body 120 is a surface that is perpendicular to one surface and the other surface of the body 120 and defines a lateral outer surface of the body 120. Here, the side surface 127 of the body 120 is a surface that is perpendicular to one surface and the other surface of the body 120 and defines a lateral outer surface of the body 120.

Of course, the air flow hole 210 may be located between the first light emitting device module 100-1 and the second light emitting device module 100-2 which are next to each other in the transversal direction, and may be located between the first light emitting device module 100-1 and a third light emitting device module 100-3 which are next to each other in the longitudinal direction.

In addition, the side surfaces 127 of the bodies 120 of the two neighboring light emitting device modules may include a portion of an air guide similar to air guide 160, extending along outer ends of several of the radiation fins 130, so that two neighboring light emitting device modules together form an air flow hole 210 and an air guide similar to air guide 160.

The module array 200 may further include connection members 220 configured to connect neighboring light emitting device modules 100.

The connection members 220 may interconnect the bodies 120 of the neighboring light emitting device modules 100.

According to the embodiment, two connection members 220 may be spaced apart from each other on a per light emitting device basis.

The connection members 220 may be formed of a material having high heat transfer efficiency in consideration of the fact that the connection members 220 define the rim of the air flow hole 210.

The connection members 220 may be formed of a material having high heat transfer efficiency, for example, at least one of aluminum (Al), nickel (Ni), copper (Cu), silver (Ag) and tin (Sn).

Specifically, referring to FIG. 2, side surfaces 221 of the two connection members 220 spaced apart from each other and the side surfaces 127 of the bodies 120 of the neighboring light emitting device modules 100 may define the inner circumferential surface of the air flow hole 210. Here, the side surface 221 of the connection member 220 refers to a surface perpendicular to the X-Z plane.

For example, the air flow hole 210 may have any one of rectangular, polygonal and circular cross sections.

In particular, assuming that the air flow hole 210 has a rectangular cross section, the side surfaces 127 of the bodies 120 of the first light emitting device module 100-1 and the second light emitting device module 100-2 which are next to each other define facing surfaces of a rectangle, and the side surfaces 221 of the two connection members 220 which interconnect the first light emitting device module 100-1 and the second light emitting device module 100-2 define the other two facing surfaces of the rectangle.

Explaining this again, the light emitting device modules 100 are horizontally spaced apart from each other and connected to each other by the connection members 220. In this case, the vertically perforated air flow hole 210 is defined by the side surfaces 221 of the connection members 220 and the side surfaces 127 of the bodies 120 of the neighboring light emitting device modules 100.

In addition, the connection members 220 may be positioned respectively at positions of the side surface 127 of the body 120 proximate to corners. As exemplarily shown in FIG. 2, positioning the connection members 220 so as to be proximate to the corners of the side surface 127 of the body 120 may increase the size of the air flow hole 210 and may further facilitate circulation of air between the interior and the exterior of the air flow hole 210.

In addition, the connection members 220 may be formed integrally with or separately from the body 120.

Figure 6:
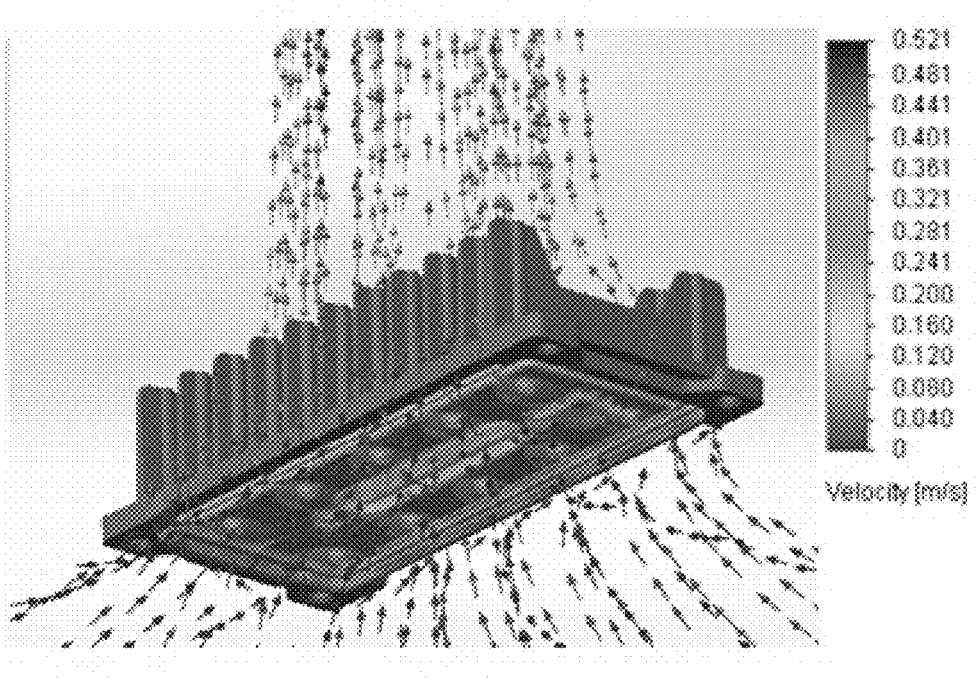
FIG. 6 is a view showing the velocity distribution of air in the light emitting device module according to the first embodiment.

FIG. 6 is a view showing the velocity distribution of air in the light emitting device module according to the embodiment. Hereinafter, the flow of air and the radiation of heat in the light emitting device module will be described with reference to FIG. 6.

The light emitting device module 100 is generally oriented in such a manner that the light emitting devices 111 face downwardly in the direction of gravity, in order to illuminate an object on the ground.

When power is applied to the light emitting devices 111, the light emitting devices 111 generate light and also generate heat. The heat generated from the light emitting devices 111 is transferred to the board 112 and the heat radiation pad 150 and then diffused to the body 120, the air guide 160 and the radiation fins 130.

In particular, most of the heat generated from the light emitting devices 111 will be transferred to the body 120, the radiation fins 130 and the air guide 160, all of which are formed of materials having high heat transfer efficiency.

Accordingly, a temperature difference occurs between the exterior and the interior of the light emitting device module 100. In particular, the interior of the air hole 122 and the air guide 160 has a higher temperature than that of the exterior of the light emitting device module 100.

Accordingly, the interior air of the air hole 122 and the air guide 160 is moved upward by buoyancy, and cold air is introduced upward from the exterior below the light emitting devices 111, to create a chimney effect.

This circulation of air may maximize heat radiation of the light emitting devices 111 using the outside air.

In particular, as exemplarily shown in FIG. 6, the velocity of air having passed through the air guide 160 and the air hole 122 is higher than that of air in other regions. Accordingly, the embodiment may achieve fan-like cooling without using a fan.

In addition, the provision of the air flow hole 210 between the neighboring light emitting device modules 100 may cause a chimney effect due to a temperature difference between the interior and the exterior of the air flow hole 210, thereby facilitating circulation of air.

The circulation of air facilitated by this chimney effect may result in more effective cooling of the light emitting device module 100.

Figure 7:
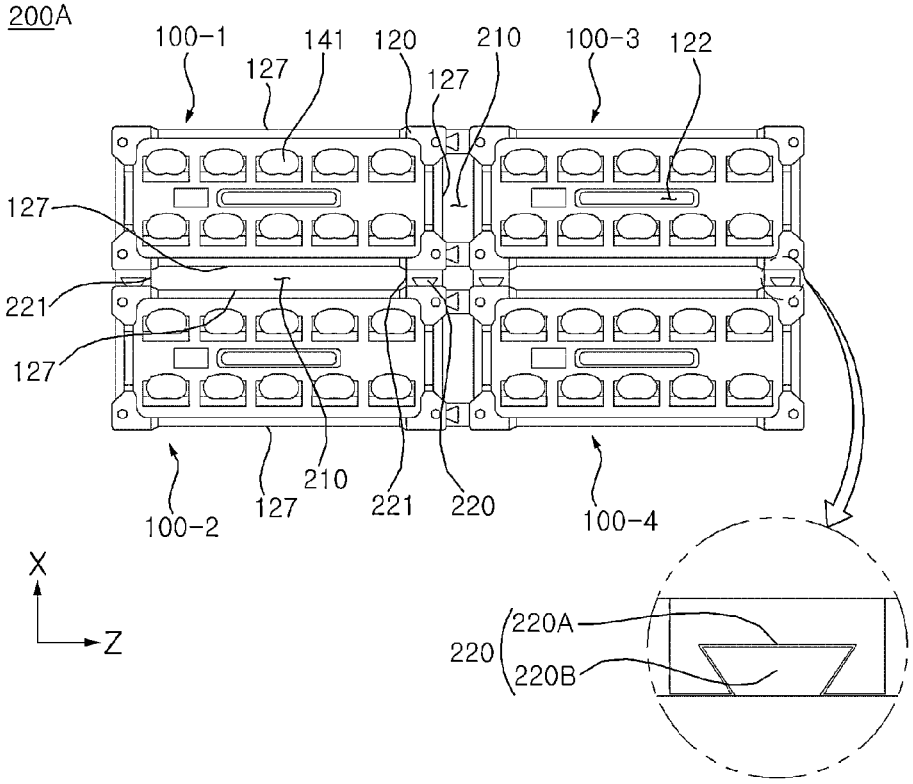
FIG. 7 is a lower side view of a module array according to another embodiment of the present invention.

FIG. 7 is a lower side view of a module array according to another embodiment of the present invention.

The module array according to the present embodiment, designated by reference numeral 200A, differs from that of the embodiment shown in FIG. 2 in terms of the configuration of the connection member 220.

The connection member 220 according to the embodiment may include a slide groove 220A formed in the body 120 of any one light emitting device module (for example, the first light emitting device module 100-1) and a slide protrusion 220B formed at the body 120 of the other light emitting device module (for example, the second light emitting device module 100-2) proximate to the first light emitting device module 100-1, the slide protrusion 220B being configured to slide and be fitted into the slide groove 220A.

The slide groove 220A provides a space into which the slide protrusion 220B is fitted and secured. The slide groove 220A may have a shape corresponding to the shape of the slide protrusion 220B to allow the slide protrusion 220B to slide and be fitted therein. Specifically, the slide groove 220A may be tapered such that the width thereof is reduced outward, like part of a dovetail joint.

The slide groove 220A may be formed in the body 120 of any one light emitting device module 100-1. The slide groove 220A may be formed integrally with or separately from the body 120. The slide groove 200A may be horizontally indented in the side surface 127 of the body 120.

The slide protrusion 220B is fitted into the slide groove 220A via sliding thereof. The slide protrusion 220B may have a shape corresponding to the shape of the slide groove 220A so as to slide and be fitted into the slide groove 220A. In particular, for convenience of assembly, the slide protrusion 220B may be vertically inserted into the slide groove 220A.

Specifically, the slide protrusion 220B may be tapered such that the width thereof is increased outward, like part of a dovetail joint.

The slide protrusion 220B may be formed at the body 120 of any one light emitting device module 100-2. The slide protrusion 220B may be formed integrally with or separately from the body 120. Specifically, the slide protrusion 220B may horizontally protrude from the side surface 127 of the body 120.

To enhance coupling force between the light emitting device modules 100, the slide protrusion 220B may be interference-fitted into the slide groove 220A.

Through use of the slide protrusion 220B and the slide groove 220A, the neighboring light emitting device modules 100 may be conveniently assembled with each other while defining the air flow hole 210 therebetween.

In addition, the number of the light emitting device modules 100 included in the module array 200 may be easily adjusted in consideration of the lighting capacity and the spatial volume of the lighting apparatus.

Figure 8:
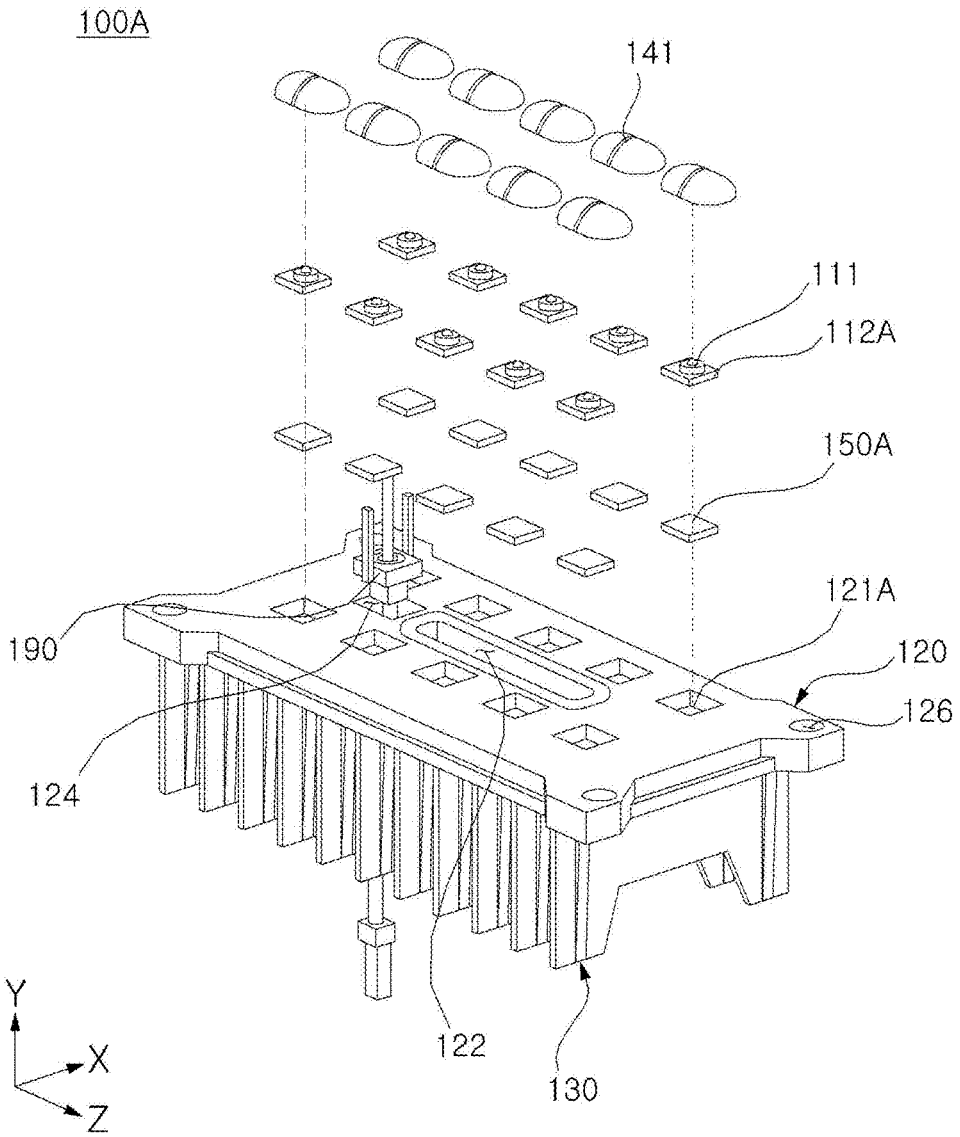
FIG. 8 is an exploded perspective view of a light emitting device module according to a second embodiment.

FIG. 8 is an exploded perspective view of a light emitting device module according to a second embodiment. Referring to FIG. 8, the light emitting device module 100A may include a body 120 provided at one surface thereof with a plurality of seats 121A, and a plurality of radiation fins 130 arranged at the other surface of the body 120 opposite to the one surface of the body 120 provided with the seats 121A.

In addition, the light emitting device module 100A may include an air hole 122 perforated in the body 120 from the seats 121A to the radiation fins 130 for the flow of air.

A plurality of boards 112A are provided, and light emitting devices 111 are disposed on the boards 112A, the light emitting devices 111 being electrically connected to the boards 112A.

The boards 112A are disposed on one surface of the body 120. The boards 112A have the form of a square, without being limited thereto. For example, the boards 112A may have one of various shapes, such as a polygonal shape, an oval shape, etc. The boards 112A may include a circuit pattern printed on an insulator. For example, the boards 112A may be general Printed Circuit Boards (PCB), a metal core PCB, a flexible PCB, a ceramic PCB or the like.

An upper surface of the boards 112A may be coated with a material capable of efficiently reflecting light. For example, the upper surface of the boards 112A may be coated with a white or silvery material.

A single light emitting device or a plurality of light emitting devices 111 may be arranged. In addition, in the case of arrangement of the plurality of light emitting devices 111, the respective light emitting devices 111 may emit different colors of light, or may exhibit different color temperatures.

The boards 112A may be disposed on the seats 121A formed at one surface of the body 120 and be supported by the body 120. The seats 121A may be indented in one surface of the body 120, and the boards 112A may have a shape corresponding to the shape of the seats 121A so as to be inserted into the seats 121A.

In this embodiment, the board hole 113 of the first embodiment is not provided, since the air hole 122 is not obstructed by the boards 112A.

The light emitting devices 111 on the boards 112A may be arranged to surround the air hole 122. More specifically, the light emitting devices 111 may be arranged around the air hole 122 in the X-Z plane.

A plurality of heat radiation pads 150A may be additionally provided between the boards 112A and the seats 121A for enhancement of heat transfer. The heat radiation pads 150A may have a shape corresponding to the seats 121A and may be formed of a material having excellent heat transfer and adhesion properties. For example, the heat radiation pads 150A may be formed of silicon.

The light emitting device module 100A may further include a plurality of lenses 141 which shield the light emitting devices 111 and refract light emitted from the light emitting devices 111. The lenses 141 function to diffuse light emitted from the light emitting devices 111. A diffusion angle of light emitted from the light emitting devices 111 may be determined based on the shape of the lenses 141. For example, the lenses 141 may allow the light emitting devices 111 to be molded in a convex form.

The lenses 141 may be formed of a light transmitting material. For example, the lenses 141 may be formed of transparent silicon, epoxy and one or more various other resins.

In addition, each lens 141 may be positioned to enclose the light emitting device 111 to isolate the light emitting device 111 from the outside, in order to protect the light emitting device 111 from external moisture and shock.

This configuration of the boards 112A, seats 121A, pads 150A and lenses 141 as discrete elements eliminates the need for the board hole 113, the pad hole 153 and the cover hole 143 of the first embodiment, while still permitting heat of the light emitting devices 111 to enter the air hole 122.

Screw holes 126 may be formed in corners of the body 120 such that screws are fastened through the screw holes 126 for coupling the body 120 to a lighting apparatus, for example.

In addition, the body 120 may have a connector hole 124 for passage of a connector 190 used to supply power to the light emitting devices 111.

Figure 9:
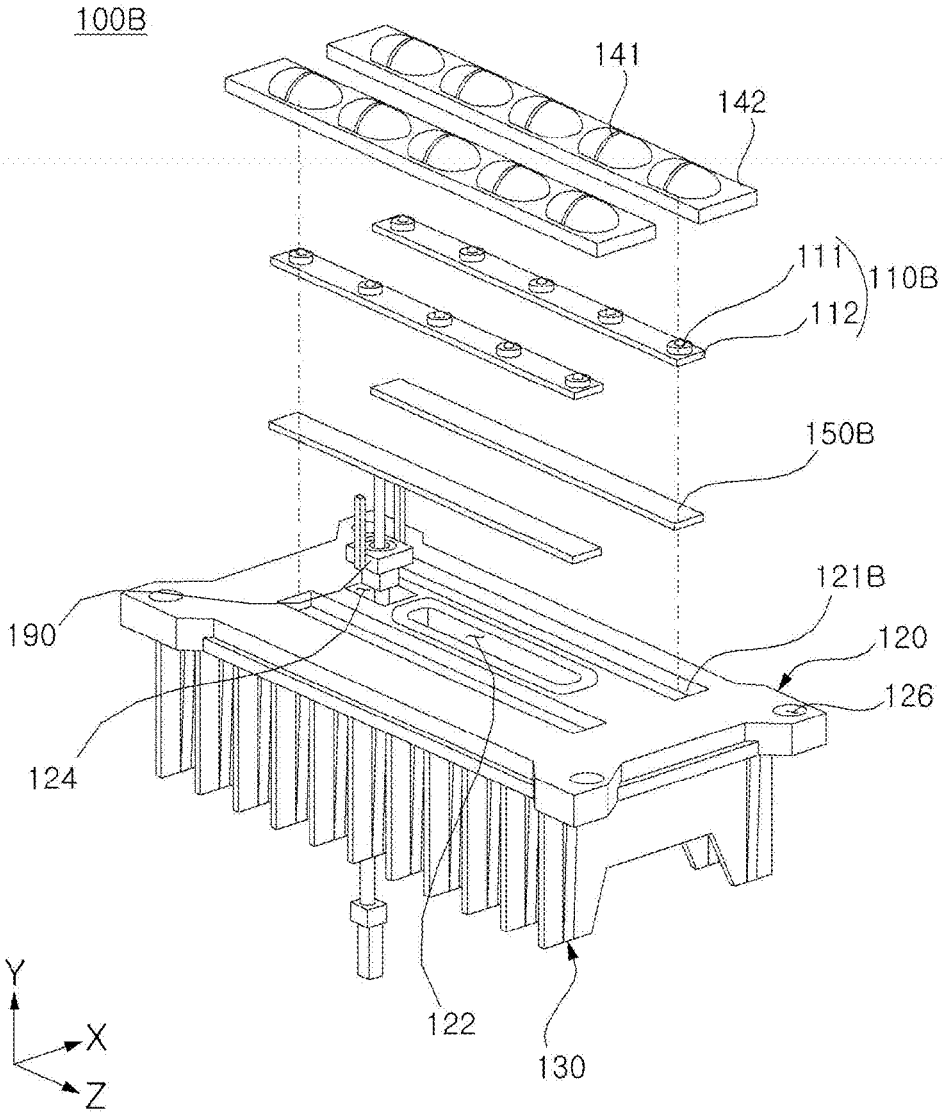
FIG. 9 is an exploded perspective view of a light emitting device module according to a third embodiment.

FIG. 9 is an exploded perspective view of a light emitting device module according to a third embodiment. Referring to FIG. 9, the light emitting device module 100B may include a plurality of light source units 110B, a body 120 provided at one surface thereof with a plurality of seats 121B on which the light source units 110B are seated, and a plurality of radiation fins 130 arranged at the other surface of the body 120 opposite to the one surface of the body 120 provided with the seats 121B. In this embodiment, two light source units 110B are provided spaced apart from one another, and generally parallel with one another, although not limited thereto.

In addition, the light emitting device module 100B may include an air hole 122 perforated in the body 120 from the seats 121B to the radiation fins 130 for the flow of air.

The light source units 110B include a board 112, and light emitting devices 111 disposed on the board 112, the light emitting devices 111 being electrically connected to the board 112. In this embodiment, two light source units 110B are provided spaced apart from one another, such that two boards 112 are provided.

The boards 112 are disposed on one surface of the body 120. The boards 112 have the form of an elongate rectangular strip, without being limited thereto. The boards 112 may include a circuit pattern printed on an insulator. For example, each board 112 may be a general Printed Circuit Board (PCB), a metal core PCB, a flexible PCB, a ceramic PCB or the like.

An upper surface of the boards 112 may be coated with a material capable of efficiently reflecting light. For example, the upper surface of the boards 112 may be coated with a white or silvery material.

A single light emitting device or a plurality of light emitting devices 111 may be arranged. In addition, in the case of arrangement of the plurality of light emitting devices 111, the respective light emitting devices 111 may emit different colors of light, or may exhibit different color temperatures.

The boards 112 may be disposed on the seats 121B formed at one surface of the body 120 and be supported by the body 120. The seats 121B may be indented in one surface of the body 120, and the boards 112 may have a shape corresponding to the shape of the seats 121B so as to be inserted into the seats 121B.

In this embodiment, the board hole 113 of the first embodiment is not provided, since the air hole 122 is not obstructed by the boards 112.

The light emitting devices 111 on the boards 112 may be arranged to surround the air hole 122. More specifically, the light emitting devices 111 may be arranged around the air hole 122 in the X-Z plane.

A plurality of heat radiation pads 150B may be additionally provided between the boards 112 and the seats 121B for enhancement of heat transfer. The heat radiation pads 150B may have a shape corresponding to the seats 121B and may be formed of a material having excellent heat transfer and adhesion properties. For example, the heat radiation pads 150B may be formed of silicon.

The light emitting device module 100B may further include a plurality of lenses 141 which shield the light emitting devices 111 and refract light emitted from the light emitting devices 111. The lenses 141 function to diffuse light emitted from the light emitting devices 111. A diffusion angle of light emitted from the light emitting devices 111 may be determined based on the shape of the lenses 141. For example, the lenses 141 may allow the light emitting devices 111 to be molded in a convex form.

The lenses 141 may be formed of a light transmitting material. For example, the lenses 141 may be formed of transparent silicon, epoxy and one or more various other resins.

In addition, each lens 141 may be positioned to enclose the light emitting device 111 to isolate the light emitting device 111 from the outside, in order to protect the light emitting device 111 from external moisture and shock.

For convenience of assembly, the lenses 141 may be disposed on a lens cover 142 having a shape corresponding to the shape of the boards 112. The lens cover 142 may be formed to correspond to the boards 112, and the lenses 141 on the lens cover 142 may be positioned to overlap the respective light emitting devices 111.

This configuration of the boards 112, seats 121B, pads 150B and lens covers 142 as separate spaced-apart units eliminates the need for the board hole 113, the pad hole 153 and the cover hole 143 of the first embodiment, while still permitting heat of the light emitting devices 111 to enter the air hole 122.

Screw holes 126 may be formed in corners of the body 120 such that screws are fastened through the screw holes 126 for coupling the body 120 to a lighting apparatus, for example.

In addition, the body 120 may have a connector hole 124 for passage of a connector 190 used to supply power to the light emitting devices 111.

Figure 10:
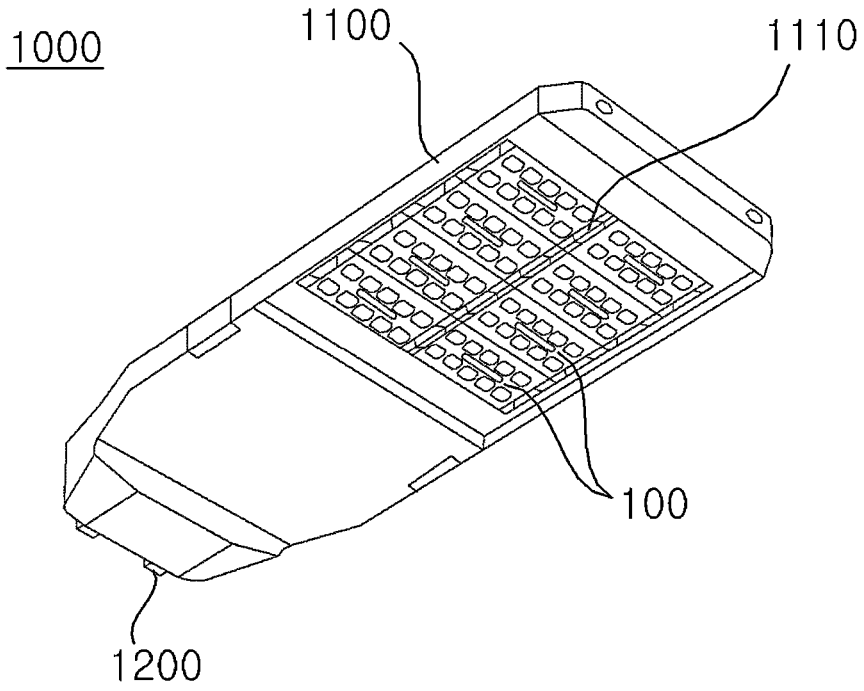
FIG. 10 is a perspective view of a lighting apparatus including light emitting device modules according to the present invention.

FIG. 10 is a perspective view of a lighting apparatus including the light emitting device modules 100 according to the present invention. Referring to FIG. 10, the lighting apparatus of the embodiment, designated by reference numeral 1000, may include a main body 1100 that provides a space for installation of the light emitting device modules 100 and defines an external appearance of the lighting apparatus 1000, and a connector 1200 that is coupled to one side of the main body 1100 and connects the main body 1100 to a support member (not shown), a power source unit (not shown) to supply power to the main body 1100 being mounted in the connector 1200.

The lighting apparatus 1000 of the embodiment may be installed indoors or outdoors. For example, the lighting apparatus 1000 of the embodiment may be applied to a streetlamp.

The main body 1100 may be organized by a plurality of frames 1110 to provide a space for installation of at least three light emitting device modules 100.

The connector 1200 incorporates the power source unit (not shown) therein and connects the main body 1100 to the support member (not shown). The support member serves to fix the main body 1100 to an external structure.

Through use of the lighting apparatus 1000 of the embodiment, heat generated by the light emitting device modules 100 may be effectively dissipated by a chimney effect without using a fan, which results in reduced manufacturing costs.

As is apparent from the above description, according to the embodiment, the interior of an air hole and an air guide has a higher temperature than that of the exterior of a light emitting device module, which causes air inside the air hole and the air guide to be moved upward by buoyancy and cold air to be introduced from the exterior below light emitting devices (chimney effect). In this way, heat generated by the light emitting device module may be effectively dissipated.

In addition, according to the embodiment, the velocity of air having passed through the air hole and the air guide is faster than that in general convection caused by heat, resulting in enhanced heat radiation efficiency.

In addition, according to the embodiment, effective cooling may be accomplished without using a fan.

When using a lighting apparatus according to the embodiment, heat generated by the light emitting device module may be effectively dissipated by a chimney effect without using a fan, which may cause a reduction of manufacturing costs.

In addition, according to the embodiment, an air flow hole is defined between neighboring light emitting device modules to facilitate circulation of air based on a chimney effect due to a temperature difference between the interior and the exterior of the air flow hole.

In addition, according to the embodiment, through provision of a slide protrusion and a slide groove, the neighboring light emitting device modules may be more conveniently assembled while defining the air flow hole therebetween.

In addition, according to the embodiment, the number of light emitting device modules included in a module array may be easily adjusted in consideration of the lighting capacity and the spatial volume of the lighting apparatus.

Although the preferred embodiments of the present invention have been disclosed for illustrative purposes, those skilled in the art will appreciate that various modifications, additions and substitutions are possible, without departing from the scope and spirit of the invention as disclosed in the accompanying claims. For example, the respective components specifically defined in the embodiments may be modified. In addition, differences associated with these modifications and applications should be interpreted to be embraced in the scope of the present invention as defined in the accompanying claims.

What is claimed is:

1. A light emitting device module comprising:

a body having a first side and a second side opposite to the first side;

a light source unit located at the first side of the body;

a plurality of radiation fins disposed on the second side of the body, the plurality of radiation fins extending from the second side of the body in a first direction;

an air hole perforated in the body and extending from the first side of the body to the second side of the body for the flow of air therethrough; and an air guide located at the second side of the body and extending from the second side of the body in the first direction, the air guide being in communication with the air hole to guide the flow of air therethrough, wherein the air guide is configured to protrude from the second side of the body along a rim of the air hole, wherein the air guide is directly connected to at least two of the radiation fins, wherein the air guide is a cylindrical member having an inner space, wherein a rim of the air guide overlaps with the rim of the air hole, wherein an edge of the air guide is spaced from the second side of the body by a first distance, wherein an edge of end portions of the radiation fins is spaced from the second side of the body by a second distance, and an edge of a center portion of the radiation fins is spaced from the second side of the body by a third distance, wherein at least a part of the air guide overlaps with the center portion of the radiation fins, and wherein the first distance is greater than the third distance.

2. The light emitting device module according to claim 1, wherein the light source unit includes:

a board seated on the first side of the body; and a plurality of light emitting devices disposed on the board, wherein the board includes a board hole communicating with the air hole.

3. The light emitting device module according to claim 2, further comprising a plurality of lenses configured to shield the light emitting devices and to refract light emitted from the light emitting devices.

4. The light emitting device module according to claim 3, wherein the lenses are disposed on a lens cover, the lens cover having a shape corresponding to that of the board, and wherein the lens cover includes a cover hole communicating with the air hole.

5. The light emitting device module according to claim 1, wherein each of the radiation fins is elongated in the transverse direction of the body, and wherein a center portion of at least one radiation fin is indented toward the body from both end portions of the radiation fin.

6. The light emitting device module according to claim 5, wherein the air hole is positioned to overlie the center portion of the at least one radiation fin, and wherein the light emitting devices are positioned to overlie both end portions of the radiation fin.

7. A light emitting device module comprising:

a body having a lower side and an upper side opposite to the lower side;

a light source unit located at the lower side of the body;

a plurality of radiation fins disposed on the upper side of the body, the plurality of radiation fins extending from the upper side of the body in a first direction;

a passive airflow promotion channel extending through the body from the lower side of the body to the upper side of the body, the passive airflow promotion channel including an air guide located at the upper side of the body and extending from the upper side of the body in the first direction, the passive airflow promotion channel being configured such that rising air heated by the light source unit at the lower side of the body is induced into the passive airflow promotion channel for passage therethrough to a location at the upper side of the body, wherein the passive airflow promotion channel further includes an air hole perforated in the body and extending from the lower side of the body to the upper side of the body for the flow of air therethrough, the air guide being in communication with the air hole to guide the flow of air therethrough, wherein the air guide is configured to protrude from the upper side of the body along a rim of the air hole, wherein the air guide is directly connected to at least two of the radiation fins, wherein the air guide is a cylindrical member having an inner space, wherein a rim of the air guide overlaps with the rim of the air hole, wherein an edge of the air guide is spaced from the upper side of the body by a first distance, wherein an edge of end portions of the radiation fins is spaced from the upper side of the body by a second distance, and an edge of a center portion of the radiation fins is spaced from the upper side of the body by a third distance, wherein at least a part of the air guide overlaps with the center portion of the radiation fins, and wherein the first distance is greater than the third distance.

8. The light emitting device module according to claim 7, wherein the air guide includes a sidewall contacting a plurality of the radiation fins, the sidewall having a height extending along a majority of a height of the radiation fins.

9. The light emitting device module according to claim 7, wherein the light source unit includes:

a board located at the upper side of the body;

a plurality of light emitting devices disposed on the board;

a board hole extending through the board, the board hole being in communication with the air hole;

a plurality of lenses configured to shield the light emitting devices and to refract light emitted from the light emitting devices;

a lens cover supporting the lenses, the lens cover having a shape generally corresponding to a shape of the board; and a cover hole extending through the lens cover, the cover hole being in communication with the air hole.

10. The light emitting device module according to claim 7, wherein the light source unit includes:

a plurality of boards located at the first side of the body, each board including a light emitting device disposed on the board, wherein the passive airflow promotion channel is located between at least two of the boards.

11. The light emitting device module according to claim 10, further comprising:

a lens disposed on each of the boards, the lens being configured to shield the light emitting devices and to refract light emitted from the light emitting devices.

12. The light emitting device module according to claim 7, wherein the light source unit includes:

a first board located at the first side of the body;

a second board located at the first side of the body;

a first plurality of light emitting devices disposed on the first board; and a second plurality of light emitting devices disposed on the second board, wherein the passive airflow promotion channel is located between the first board and the second board.

13. The light emitting device module according to claim 12, further comprising:

a first lens cover having a shape corresponding to that of the first board;

a second lens cover having a shape corresponding to that of the second board; and a plurality of lenses disposed on the first lens cover and the second lens cover, the plurality of lenses being configured to shield the light emitting devices and to refract light emitted from the light emitting devices.

14. A lighting apparatus comprising:

a main body; and a light emitting device module received by said main body, the light emitting device module comprising:

a body having a first side and a second side opposite to the first side;

a light source unit located at the first side of the body;

a plurality of radiation fins disposed on the second side of the body, the plurality of radiation fins extending from the second side of the body in a first direction;

an air hole perforated in the body and extending from the first side of the body to the second side of the body for the flow of air therethrough; and an air guide located at the second side of the body and extending from the second side of the body in the first direction, the air guide being in communication with the air hole to guide the flow of air therethrough, wherein the air guide is configured to protrude from the second side of the body along a rim of the air hole, wherein the air guide is directly connected to at least two of the radiation fins, wherein the air guide is a cylindrical member having an inner space, wherein a rim of the air guide overlaps with the rim of the air hole, wherein an edge of the air guide is spaced from the second side of the body by a first distance, wherein an edge of end portions of the radiation fins is spaced from the second side of the body by a second distance, and an edge of a center portion of the radiation fins is spaced from the second side of the body by a third distance, wherein at least a part of the air guide overlaps with the center portion of the radiation fins, and wherein the first distance is greater than the third distance.

15. The light emitting device module according to claim 1, wherein an interior of the air guide is free of radiation fins.

16. The light emitting device module according to claim 7, wherein an interior of the air guide is free of radiation fins.

17. The lighting apparatus according to claim 14, wherein an interior of the air guide is free of radiation fins.

* * * * *